US010724278B2

(12) United States Patent
Provencher et al.

(10) Patent No.: US 10,724,278 B2
(45) Date of Patent: Jul. 28, 2020

(54) SECONDARY RETENTION DEVICE FOR BI-PARTING DOORS

(71) Applicant: Westinghouse Air Brake Technologies Corporation, Wilmerding, PA (US)

(72) Inventors: Joey Provencher, Montreal (CA); Julien Sauveur Serge Auger, Luynes (FR)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 198 days.

(21) Appl. No.: 15/892,590

(22) Filed: Feb. 9, 2018

(65) Prior Publication Data

US 2019/0249472 A1 Aug. 15, 2019

(51) Int. Cl.
*E05B 77/52* (2014.01)
*E05B 65/08* (2006.01)
(Continued)

(52) U.S. Cl.
CPC ..... *E05B 77/52* (2013.01); *E05B 65/0823* (2013.01); *E05B 65/0847* (2013.01);
(Continued)

(58) Field of Classification Search
CPC ..... E05B 77/52; E05B 83/04; E05B 83/06; E05B 65/0835; E05B 65/0847
See application file for complete search history.

(56) References Cited

U.S. PATENT DOCUMENTS 3,745,705 A 7/1973 Reddy
4,142,327 A * 3/1979 Griffith ..... E05D 15/1044 49/215
(Continued)

FOREIGN PATENT DOCUMENTS

CH 162014 A * 5/1933 ..... B60J 7/1851
CN 101117876 A 2/2008
(Continued)

OTHER PUBLICATIONS

Extended European Search Report, Application No. 19156007.7-1005, dated Jun. 28, 2019, (8) pages.
(Continued)

*Primary Examiner* — Catherine A Kelly
(74) *Attorney, Agent, or Firm* — Christopher R. Carroll; The Small Patent Law Group LLC

(57) ABSTRACT

A retention mechanism for a pair of bi-parting doors of a transit vehicle includes a first track connected to a first door of the pair; a second track connected to a second door of the pair; a first retention assembly connected to the transit vehicle and configured to retain the first track in the closed position; a second retention assembly connected to the transit vehicle and configured to retain the second track in the closed position; a first engagement member connected to the second track, the first engagement member being configured to engage the first retention assembly to cause the first retention assembly to move to retain the first track in the closed position when the second track is in the closed position; and a second engagement member connected to the first track, the second engagement member being configured to engage the second retention assembly to cause the second retention assembly to move to retain the second track in the closed position when the first track is in the closed position.

19 Claims, 13 Drawing Sheets

(51) Int. Cl.

| | |
|---|---|
| ***E05F 15/40*** | (2015.01) |
| ***E05F 15/655*** | (2015.01) |
| ***E05F 15/632*** | (2015.01) |
| ***E05B 83/36*** | (2014.01) |

(52) U.S. Cl.

CPC ..... *E05B 83/363* (2013.01); *E05F 15/40* (2015.01); *E05F 15/632* (2015.01); *E05F 15/655* (2015.01); *E05Y 2201/22* (2013.01); *E05Y 2201/606* (2013.01); *E05Y 2201/622* (2013.01); *E05Y 2201/684* (2013.01); *E05Y 2600/456* (2013.01); *E05Y 2800/25* (2013.01); *E05Y 2800/40* (2013.01); *E05Y 2900/51* (2013.01); *E05Y 2900/531* (2013.01)

(56) References Cited

U.S. PATENT DOCUMENTS

| | | | | | |
|---|---|---|---|---|---|
| 4,364,454 | A | | 12/1982 | Glaser et al. | |
| 4,457,108 | A | * | 7/1984 | Kuschel | B60J 5/062 49/118 |
| 4,573,286 | A | | 3/1986 | Favrel et al. | |
| 4,901,474 | A | * | 2/1990 | Bayard | E05F 15/565 292/144 |
| 5,148,631 | A | | 9/1992 | Bayard et al. | |
| 5,755,060 | A | * | 5/1998 | Zweili | E05B 65/0829 49/322 |
| 6,032,416 | A | * | 3/2000 | Springer | B60J 5/062 49/119 |
| 6,094,867 | A | * | 8/2000 | Reddy | B61D 19/02 49/280 |
| 6,134,838 | A | | 10/2000 | Reddy | |
| 6,446,389 | B1 | * | 9/2002 | Heffner | B61D 19/02 49/280 |
| 6,539,669 | B1 | * | 4/2003 | Heidrich | B61D 19/008 49/120 |
| 6,640,388 | B2 | | 11/2003 | Covert et al. | |
| 6,662,501 | B2 | | 12/2003 | Pagowski et al. | |
| 6,684,567 | B2 | | 2/2004 | Heidrich et al. | |
| 6,718,694 | B2 | | 4/2004 | Stojc et al. | |
| 7,228,804 | B2 | | 6/2007 | Stojc et al. | |
| 9,340,215 | B2 | * | 5/2016 | Masuda | B61D 19/007 |
| 2002/0184823 | A1 | | 12/2002 | Heffner et al. | |
| 2002/0194784 | A1 | * | 12/2002 | Stojc | E05B 47/0012 49/118 |
| 2004/0211121 | A1 | | 10/2004 | Inage | |
| 2018/0347249 | A1 | * | 12/2018 | Singh | E05F 15/40 |

FOREIGN PATENT DOCUMENTS

| | | | | | |
|---|---|---|---|---|---|
| CN | 201391153 | Y | | 1/2010 | |
| CN | 102678020 | A | | 9/2012 | |
| CN | 205314736 | U | | 6/2016 | |
| CN | 205819209 | U | | 12/2016 | |
| DE | 19930949 | A1 | * | 3/2000 | E05F 15/565 |
| DE | 19908191 | C1 | | 7/2000 | |
| EP | 0255991 | A2 | | 2/1988 | |
| EP | 0259568 | A2 | * | 3/1988 | B60J 5/062 |
| EP | 2362046 | A1 | | 8/2011 | |
| FR | 2557624 | | | 1/1984 | |
| FR | 2589938 | A1 | | 5/1987 | |
| FR | 3057010 | B1 | * | 10/2018 | E05D 15/1042 |
| GB | 2046828 | A | * | 11/1980 | E05F 15/565 |
| GB | 2100121 | A | * | 12/1982 | A47B 87/002 |
| GB | 2569343 | A | * | 6/2019 | E05F 15/657 |
| WO | WO-0148344 | A1 | * | 7/2001 | E05B 65/0835 |
| WO | 2017176831 | A1 | | 10/2017 | |

OTHER PUBLICATIONS

English translation of FR2589938A1.
English translation of DE19908191C1.
Office Action dated May 28, 2020 for corresponding Application No. 19156007.7-1005 (4 pages).

* cited by examiner

SECONDARY RETENTION DEVICE FOR BI-PARTING DOORS

BACKGROUND OF THE INVENTION

Field of the Invention

The present invention relates generally to a retention mechanism for a transit vehicle door and, in particular, to a retention mechanism that is operated to retain the transit vehicle door in the event of a failure in a door operator system.

Description of Related Art

Transit vehicles are provided with bi-parting door assemblies that include door operator mechanisms to move the door panels between open and closed positions upon command from a central control. Examples of such bi-parting door assemblies are provided in U.S. Pat. No. 7,228,804 to Stojc et al., U.S. Pat. No. 6,032,416 to Springer et al., U.S. Pat. Nos. 6,539,669 and 6,684,567 to Heidrich et al., and in International Application Publication No. WO 2017/176831 to Stojc et al. The disclosures of each the above-mentioned publications is incorporated by reference in its entirety as set forth herein.

In the event of a mechanical failure of a component of such assemblies involved in the motion transfer from the door operator mechanism to the door panel, such as a broken door arm or a broken or defective drive nut, the mechanical connection between the door panel and the door operator mechanism may become broken such that the door panel is able to slide freely when the door panel should be locked in a closed position.

SUMMARY OF THE INVENTION

According to an example of the present disclosure, a retention mechanism for a bi-parting transit vehicle door operator is provided to mitigate a single-point failure mode in the door operator while not appreciably increasing the cost or complexity of the door operator. Examples of transit vehicles that incorporate such bi-parting door operators are rail transit cars. According to this example, the retention mechanism includes a door panel suspension roller or slider assembly fixed with respect to the door frame and a door panel suspension track attached to the door panels and movable along with the door panels. The retention mechanism provides a simple means of maintaining a door panel in a closed position subject to a mechanical failure in the door operator mechanism.

According to a particular example of the present disclosure, a retention mechanism for a pair of bi-parting doors of a transit vehicle is provided. The retention mechanism comprises a first track configured to be connected to a first door of the pair of bi-parting doors, the first track having a first end and a second end, wherein the first track is movable with the first door between an open position and a closed position; a second track configured to be connected to a second door of the pair of bi-parting doors, the second track having a first end and a second end, wherein the second track is movable with the second door between an open position and a closed position; a first retention assembly configured to be connected to the transit vehicle and to retain the first track in the closed position; a second retention assembly configured to be connected to the transit vehicle to retain the second track in the closed position; a first engagement member connected to the second end of the second track, the first engagement member being configured to engage the first retention assembly to cause the first retention assembly to move to retain the first track in the closed position when the second track is in the closed position; and a second engagement member connected to the second end of the first track, the second engagement member being configured to engage the second retention assembly to cause the second retention assembly to move to retain the second track in the closed position when the first track is in the closed position.

According to another particular example of the present disclosure, a bi-parting door assembly for a transit vehicle having a door opening formed in a wall of the transit vehicle is provided. The door assembly comprises a first door and a second door disposed adjacent to the wall; a door operator system configured to move the first door and the second door in opposing directions along the door opening between respective open and closed positions, the door operator system comprising a door operator frame configured to be mounted on the transit vehicle above the door opening; and a retention mechanism for the first door and the second door. The retention mechanism comprises a first track connected to the first door, the first track having a first end and a second end, wherein the first track is movable with the first door between the open position and the closed position; a second track connected to the second door, the second track having a first end and a second end, wherein the second track is movable with the second door between the open position and the closed position; a first retention assembly connected to the door operator frame, the first retention assembly being configured to retain the first track in the closed position; a second retention assembly connected to the door operator frame, the second retention assembly being configured to retain the second track in the closed position; a first engagement member connected to the second end of the second track, the first engagement member being configured to engage the first retention assembly to cause the first retention assembly to move to retain the first track in the closed position when the second track is in the closed position; and a second engagement member connected to the second end of the first track, the second engagement member being configured to engage the second retention assembly to cause the second retention assembly to move to retain the second track in the closed position when the first track is in the closed position.

According to another particular example of the present disclosure, a retention mechanism for a transit vehicle door is provided. The retention mechanism comprises a track configured to be connected to the door, the track having a first end and a second end, wherein the track is movable with the door between an open position and a closed position; a retention assembly configured to be connected to the transit vehicle and to retain the track in the closed position; and an engagement member configured to be movably connected to the transit vehicle so as to be movable opposite to a movement of the track. The engagement member is configured to engage the retention assembly to cause the retention assembly to retain the track when the track is in the closed position.

These and other features and characteristics of the present invention, as well as the methods of operation and functions of the related elements of structures and the combination of parts and economies of manufacture, will become more apparent upon consideration of the following description and with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the invention. As used in the specification and the claims, the singular forms of "a", "an", and "the" include plural referents unless the context clearly dictates otherwise.

DETAILED DESCRIPTION OF THE INVENTION

Figure 1:
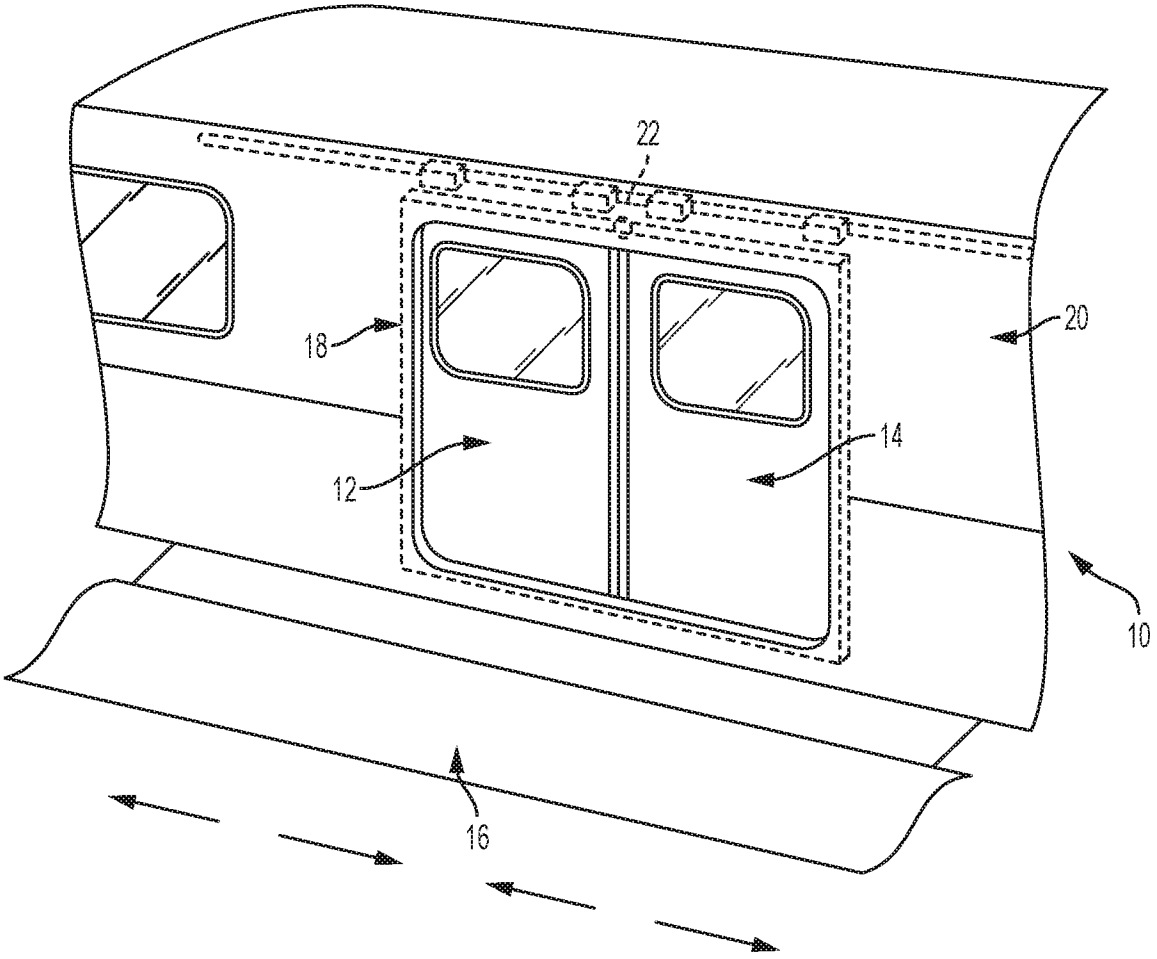
FIG. 1 is a perspective view of a portion of a transit vehicle having a bi-parting door assembly according to an example of the present disclosure.

For purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments or aspects of the invention. Hence, specific dimensions and other physical characteristics related to the embodiments or aspects disclosed herein are not to be considered as limiting.

With reference to FIG. 1, a transit vehicle 10, such as a subway car, trolley car, other rail transit vehicle, or similar vehicle, is shown according to an example of the present disclosure. The vehicle 10 includes a door assembly that includes a pair of outside bi-parting doors 12, 14 and a door operator system 22. As shown, the doors 12, 14 are closed and the transit vehicle 10 is stopped at a platform 16. The doors 12, 14 cover a passenger portal or opening 18 formed in a wall 20 of the transit vehicle 10. The doors 12, 14 are disposed adjacent to the wall 20 and are slidably suspended from the door operator system 22, which is disposed on the wall 20 above the door opening 18. The door operator system 22 moves the pair of doors 12, 14 in opposing directions along the door opening 18 between open and closed positions. According to one example, the door operator system 22 includes a drive mechanism for moving the doors 12, 14 between the open and closed positions and an overcenter locking mechanism for securing the doors in the closed position. An example of such a door operator system 22 is disclosed in International Application Publication No. WO 2017/176831 to Stojc et al. According to another example of the present disclosure, only a single door 12 may be provided to the opening 18. The door operator system 22 moves the single door 12 between the open and closed positions.

Figure 2:
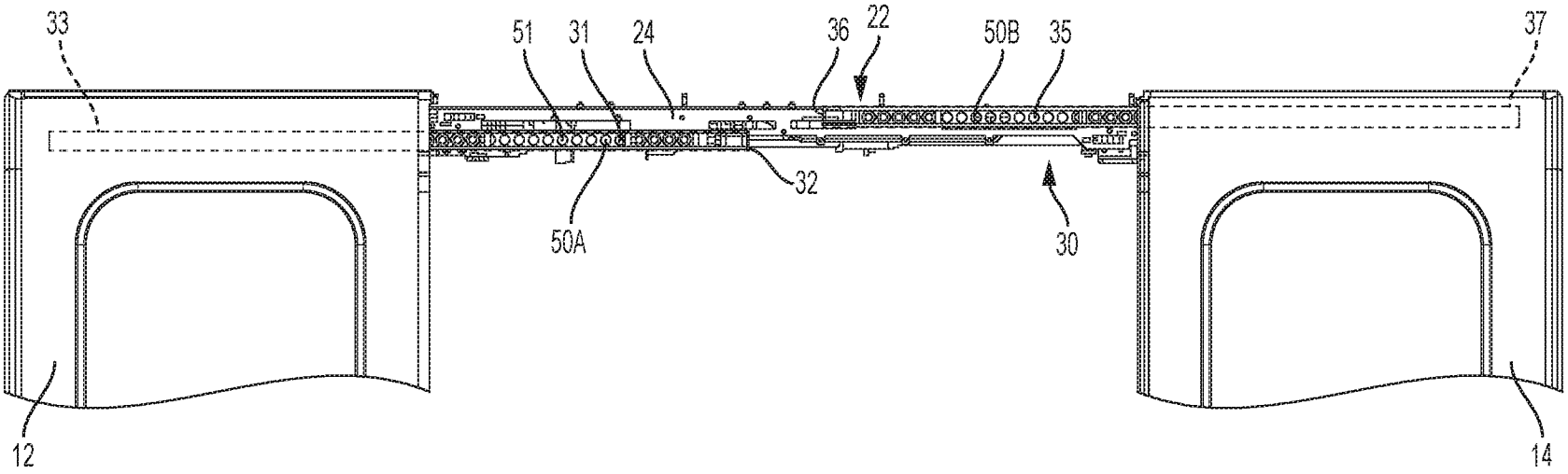
FIG. 2 is an exterior side view of a portion of the bi-parting door assembly of FIG. 1.
Figure 3:
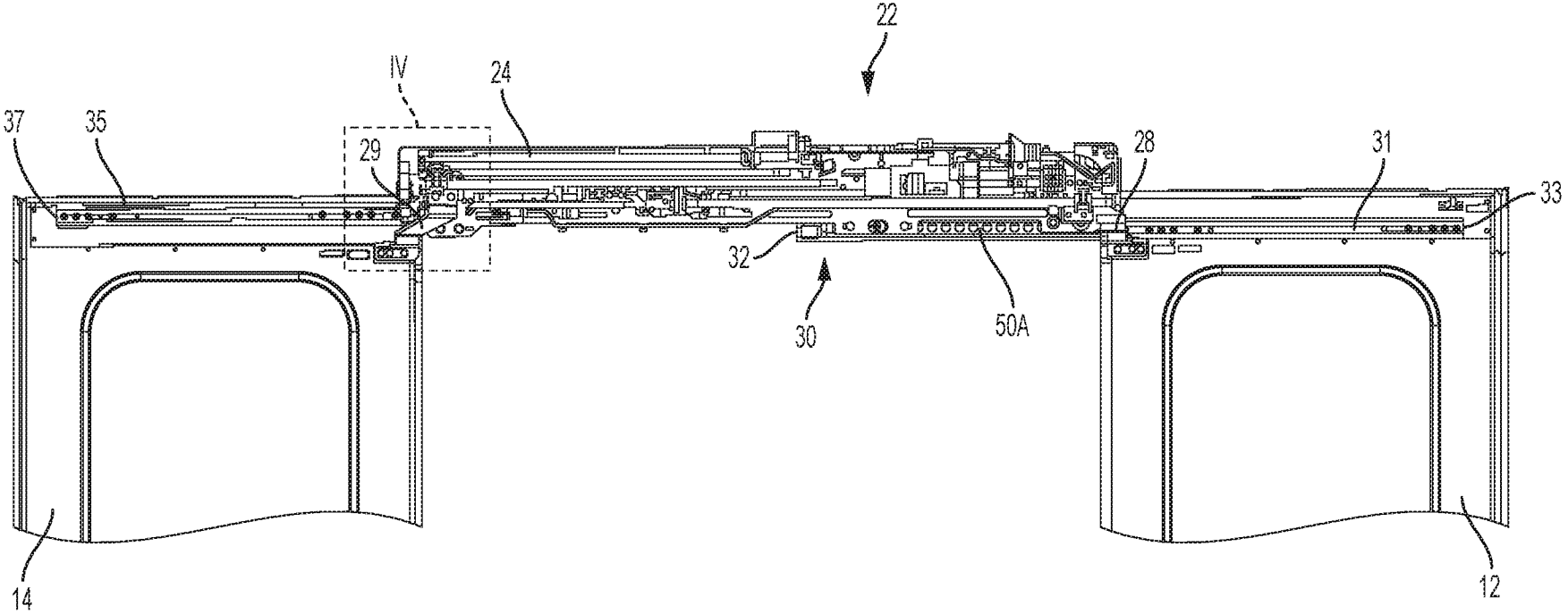
FIG. 3 is an interior side view of a portion of the bi-parting door assembly of FIG. 1.
Figure 4:
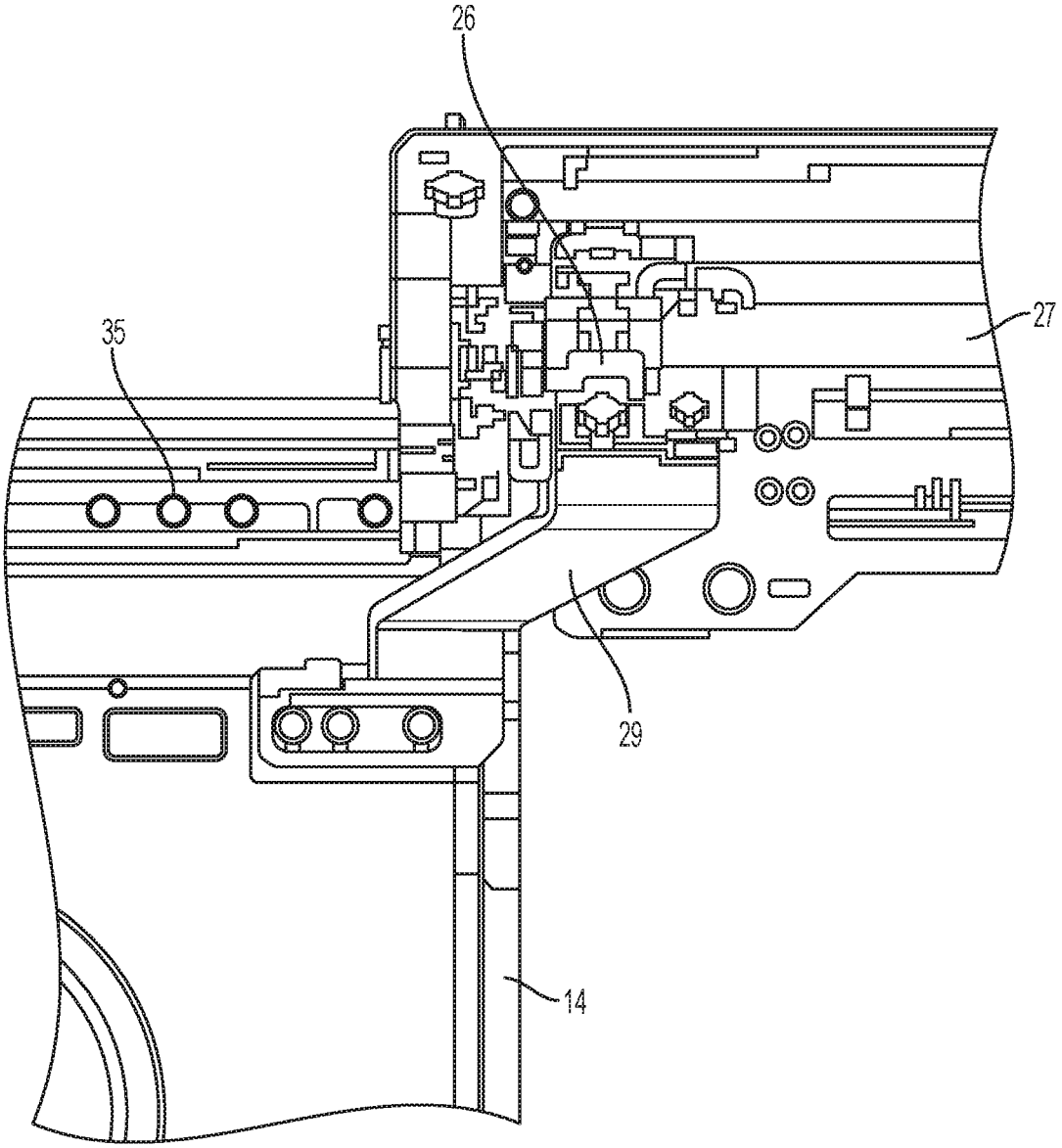
FIG. 4 is an enlarged view taken from area "IV" shown in FIG. 3.
Figure 5:
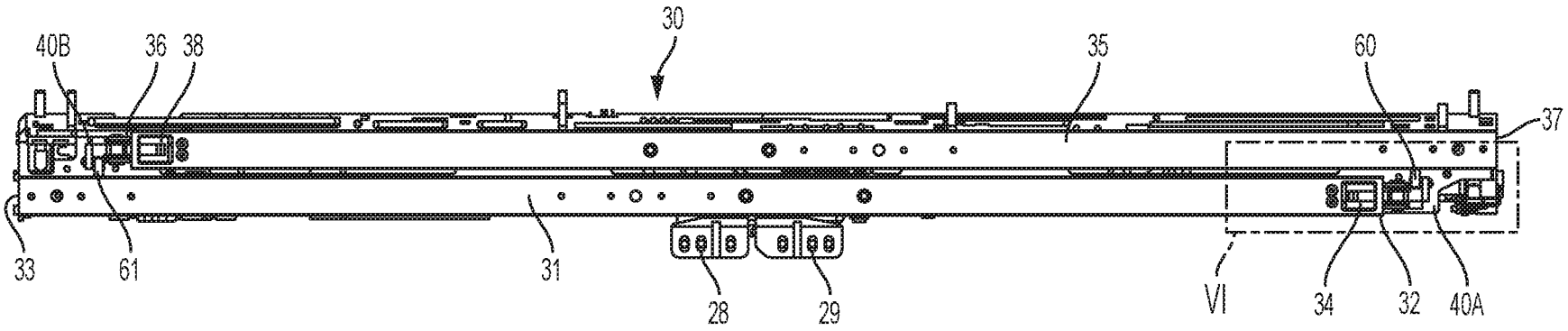
FIG. 5 is an exterior side view of a retention mechanism for the bi-parting door assembly according to an example of the present disclosure.
Figure 6:
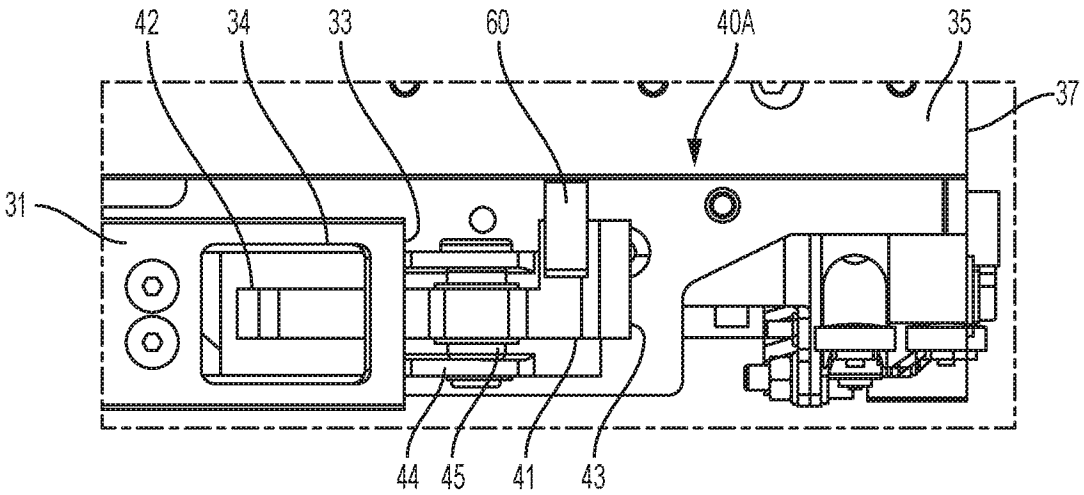
FIG. 6 is an enlarged view taken from area "VI" shown in FIG. 5.
Figure 7:
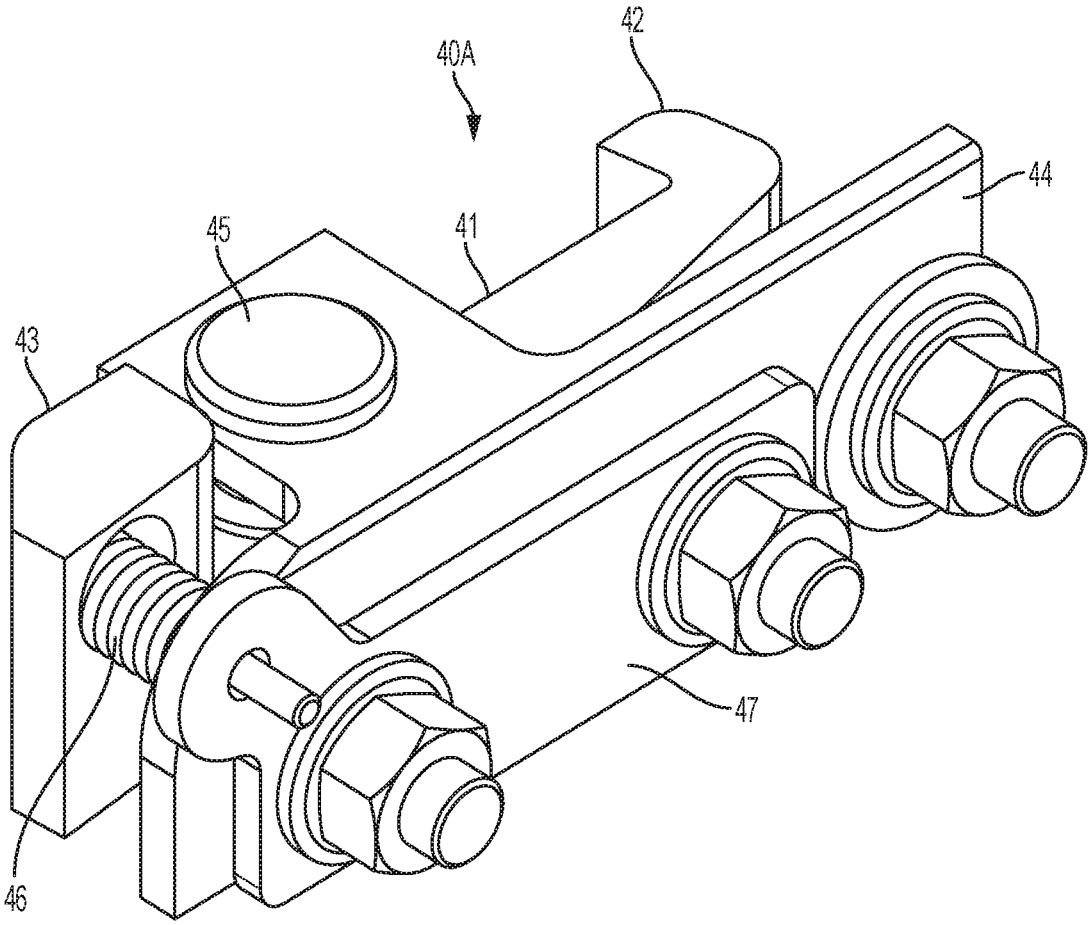
FIG. 7 is a perspective view of a retention assembly of the retention mechanism of FIG. 5.
Figure 8A:
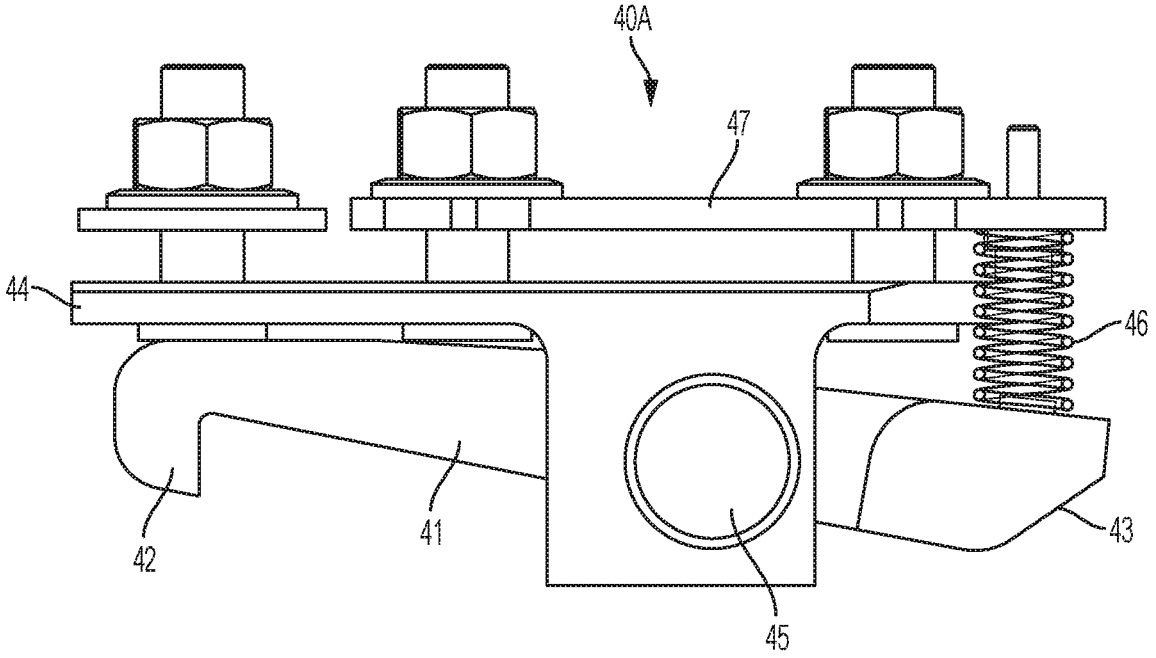
FIG. 8A is a top view of the retention assembly of FIG. 7 in a releasing position.
Figure 8B:
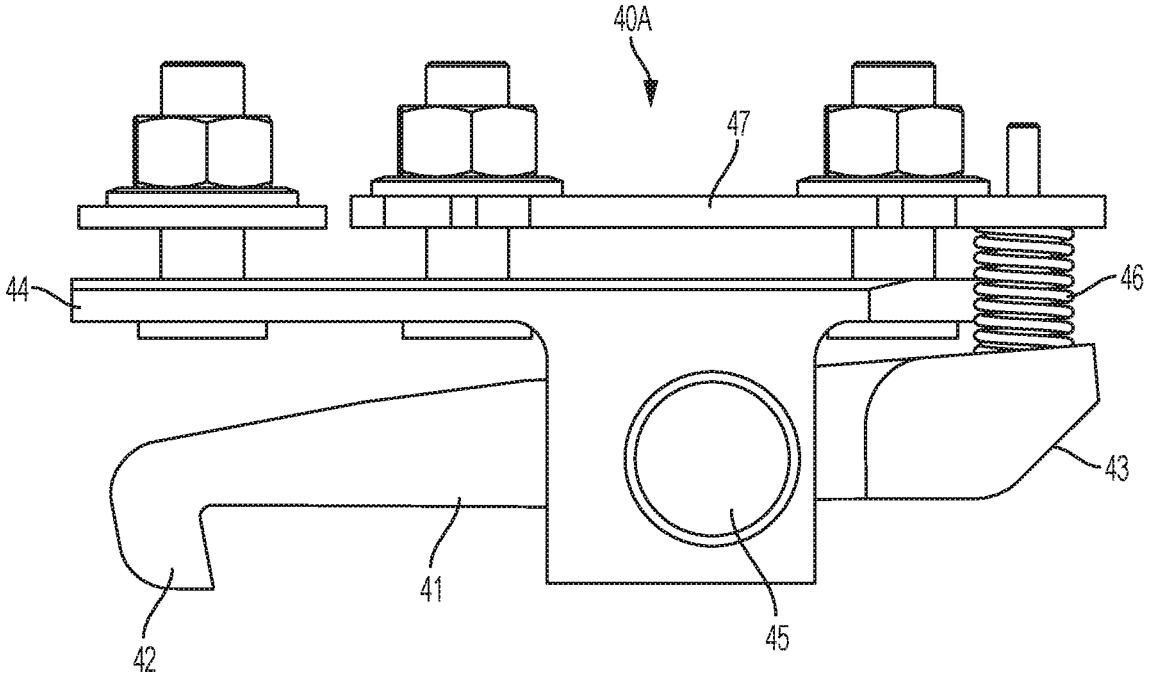
FIG. 8B is a top view of the retention assembly of FIG. 7 in a retaining position.
Figure 9A:
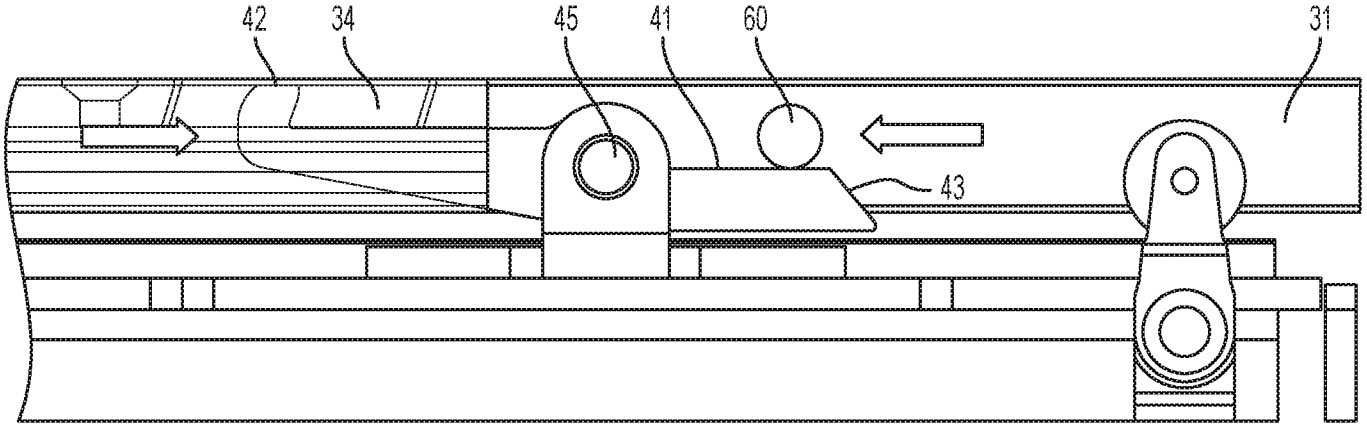
FIGS. 9A and 9B are top views of a portion of the retention mechanism of FIG. 5 when the door is in a closed and locked condition and when the door is in an unlocked condition, respectively.
Figure 9B:
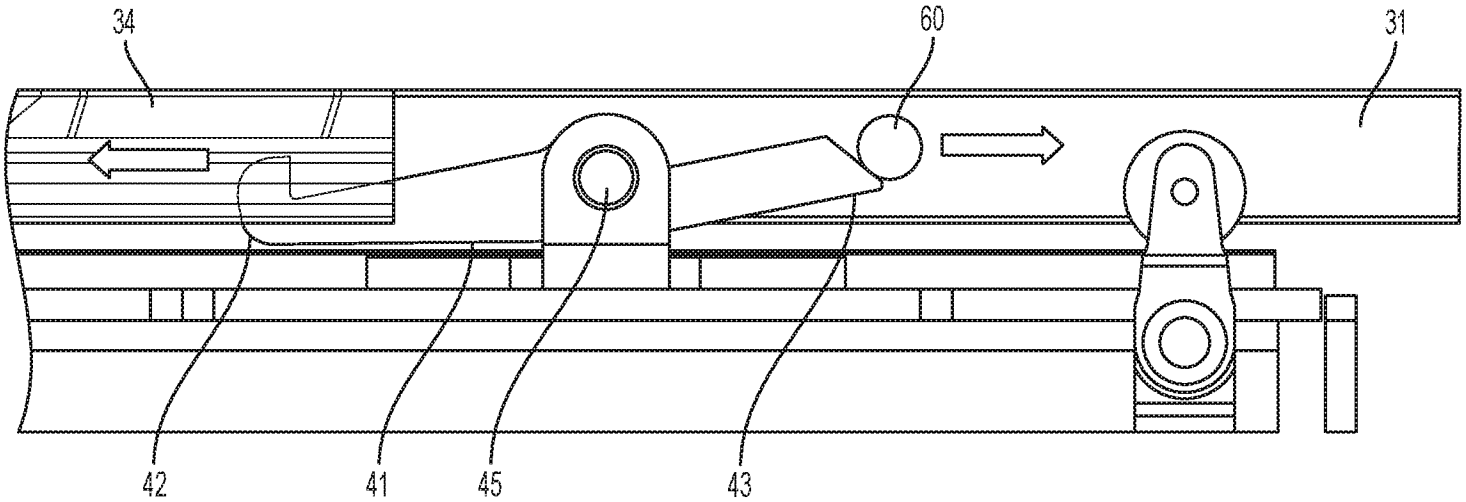

As shown in FIGS. 2-4, the door operator system 22 may include a door operator frame 24 mounted on the transit vehicle 10 above the door opening 18. The door operator system 22 may also include a drive nut 26, a drive screw 27, and first and second drive arms 28, 29 that form at least part of the drive mechanism for transferring torque from a motor (not shown) to the doors 12, 14 in order to drive the doors between the open and closed positions, as described in detail in International Application Publication No. WO 2017/176831.

A single motor (not shown) provides the motive power to move the doors 12, 14 between the open and closed positions. The motive power is transferred from the motor shaft to a pair of drive screws, such as the drive screw 27, set to turn in opposite directions. In turn, rotation of the drive screws 27 is converted into a linear motion of two drive nuts, such as the drive nut 26, in opposite directions. The drive nuts 26 are coupled to drive arms, such as the first and second drive arms 28, 29, fastened to the doors 12, 14. The drive nuts 26, when moving, transfer their motion to the drive arms 28, 29 and, hence, to the doors 12, 14. As also described in detail in International Application Publication No. WO 2017/176831, the door operator system 22 may incorporate an overcenter locking mechanism associated with each door 12, 14 that maintains the respective door 12, 14 in a closed and locked state when the door 12, 14 is moved to the closed position.

A mechanical failure in the door operator system 22 can result in a situation where one of the doors 12, 14 is operatively disconnected from the drive system and/or the overcenter locking mechanism door operator system 22 and becomes free to slide under its own weight or inertia when it should be held in the closed and locked position, i.e., a "limp door panel" condition. Examples of such mechanical failures include a broken drive arm 28, 29 and/or a broken or defective drive nut 26. A single-point failure is a failure of any component involved in the motion transfer from the door operator system 22 to the actual door 12, 14 resulting in the limp door panel condition described above.

As shown in FIGS. 2-11C, according to an example of the present disclosure shown, a retention mechanism 30 is provided in connection with the door operator system 22 to retain the door panels 12, 14 in the closed position in the event of a single-point failure in the door operator system 22. The retention mechanism 30 includes a first track 31 connected to the first door 12 and a second track 35 connected to the second door 14. The first track 31 is movable with the first door 12 between the open and closed positions and has a first end 32 associated with the side of the door 12 oriented toward the center of the opening 18 and an opposing second end 33 associated with the side of the door 12 oriented away from the center of the opening 18. The second track 35 is movable with the second door 14 between the open and closed positions and has a first end 36 associated with the side of the door 14 oriented toward the center of the opening 18 and an opposing second end 37 associated with the side of the door 14 oriented away from the center of the opening 18.

As shown in FIGS. 5-11C, the retention mechanism 30 also includes a first retention assembly 40A connected to the door operator frame 24 at a position adjacent to the position of the first end 32 of the first track 31 when the first door 12 is in the closed position and a second retention assembly 40B connected to the door operator frame 24 at a position adjacent to the position of the first end 36 of the second track 35 when the second door 14 is in the closed position. The first retention assembly 40A is configured to engage the first end 32 of the first track 31 to retain the first track 31 and the first door 12 in the closed position in the event of a single-point failure of the door operator system 22 as associated with the first door 12. The second retention assembly 40B is configured to engage the first end 36 of the second track 35 to retain the second track 35 and the second door 14 in the closed position in the event of a single-point failure of the door operator system 22 associated with the second door 14.

The retention mechanism 30 further includes a first engagement member 60 connected to the second end 37 of the second track 35 and a second engagement member 61 connected to the second end 33 of the first track 31. The first engagement member 60 is configured to engage the first retention assembly 40A to cause the first retention assembly 40A to move to retain the first track 31 in the closed position when the second track 35 is in the closed position. The second engagement member 61 is configured to engage the second retention assembly 40B to cause the second retention assembly 40B to move to retain the second track 35 in the closed position when the first track 31 is in the closed position. Accordingly, the retention mechanism 30 operates to maintain at least one of the first door 12 and the second door 14 in the respective closed position in an event of a single-point failure of the door operator system 22 based on the other door 12, 14 being driven to the closed and locked position by the door operator system 22. According to one example of the present disclosure, each of the first and second engagement members 60, 61 includes a striker pin extending from the respective second track 35 and first track 31.

As shown in FIGS. 2 and 3, each of the first track 31 and the second track 35 have a width greater than a width of the respective first door 12 and second door 14 to allow for lateral motion of the respective first door 12 and second door 14 in a direction toward the respective open position up to a maximum distance equal to the width of the respective first door 12 and second door 14. The retention mechanism 30 further includes a first suspension member 50A that is movably engaged by the first track 31 and is fixedly connected to the door operator frame 24 and a second suspension member 50B that is movably engaged by the second track 35 and is fixedly connected to the door operator frame 24. The first and second suspension members 50A, 50B vertically support the first and second tracks 31, 35, respectively, with respect to the transit vehicle 10 and allow the first and second tracks 31, 35 to move with the respective door 12, 14. According to an example of the present disclosure, each of the first and second suspension members 50A, 50B includes a roller 51 or a set of rollers configured to rollably engage the respective first track 31 and second track 35. According to another example of the present disclosure, each of the first and second suspension members 50A, 50B includes at least one sliding member configured to slidably engage the respective first track 31 and second track 35.

With reference to FIGS. 5-11C, each of the first and second retention assemblies 40A, 40B includes a retention hook 41 having a hook member 42 disposed at one end thereof and a ramp surface 43 disposed at an opposite end thereof. The retention hook 41 is mounted to the door operator frame 24 and, thus, to the transit vehicle 10 by a support plate 44. The retention hook 41 is pivotably supported on the support plate 44 by a pivot shaft 45 provided on the support plate 44. Each retention hook 41 is pivotable between a retaining position, shown in FIGS. 8B, 9A, 10, 11B, and 11C, and a releasing position, shown in FIGS. 8A, 9B, and 11A. In the retaining position, the retention hook 41 can engage the first end 32, 36 of the respective first track 31 and second track 35 to retain the respective track 31, 35 in the closed position. In the releasing position, the retention hook 41 is moved clear of the respective track 31, 35 to release the respective track 31, 35 to move between the open and closed position. The hook member 42 of the retention hook 41 is configured to engage the respective first track 31 and second track 35 when the retention hook 41 is in the retaining position, and the ramp surface 43 is configured to be engaged by the respective first engagement member 60 and second engagement member 61 to cause the retention hook 41 to be moved to the retaining position.

As shown in FIGS. 7-11C, each of the first and second retention assemblies 40A, 40B also includes a spring 46 disposed between the retention hook 41 and the support plate 44. The spring 46 engages the retention hook 41 to bias the retention hook 41 to the releasing position. In particular, the spring 46 is engaged between the end of the retention hook 41 on which the ramp surface 43 is formed and a spring support 47 fastened to the support plate 44 opposite to the retention hook 41. In this configuration, the spring 46 extends through a notch or cut away portion defined in the support plate 44. It is to be appreciated that the retention assemblies 40A, 40B may be configured such that the spring 46 directly engages the support plate 44 and the spring support 47 is omitted.

Figure 10:
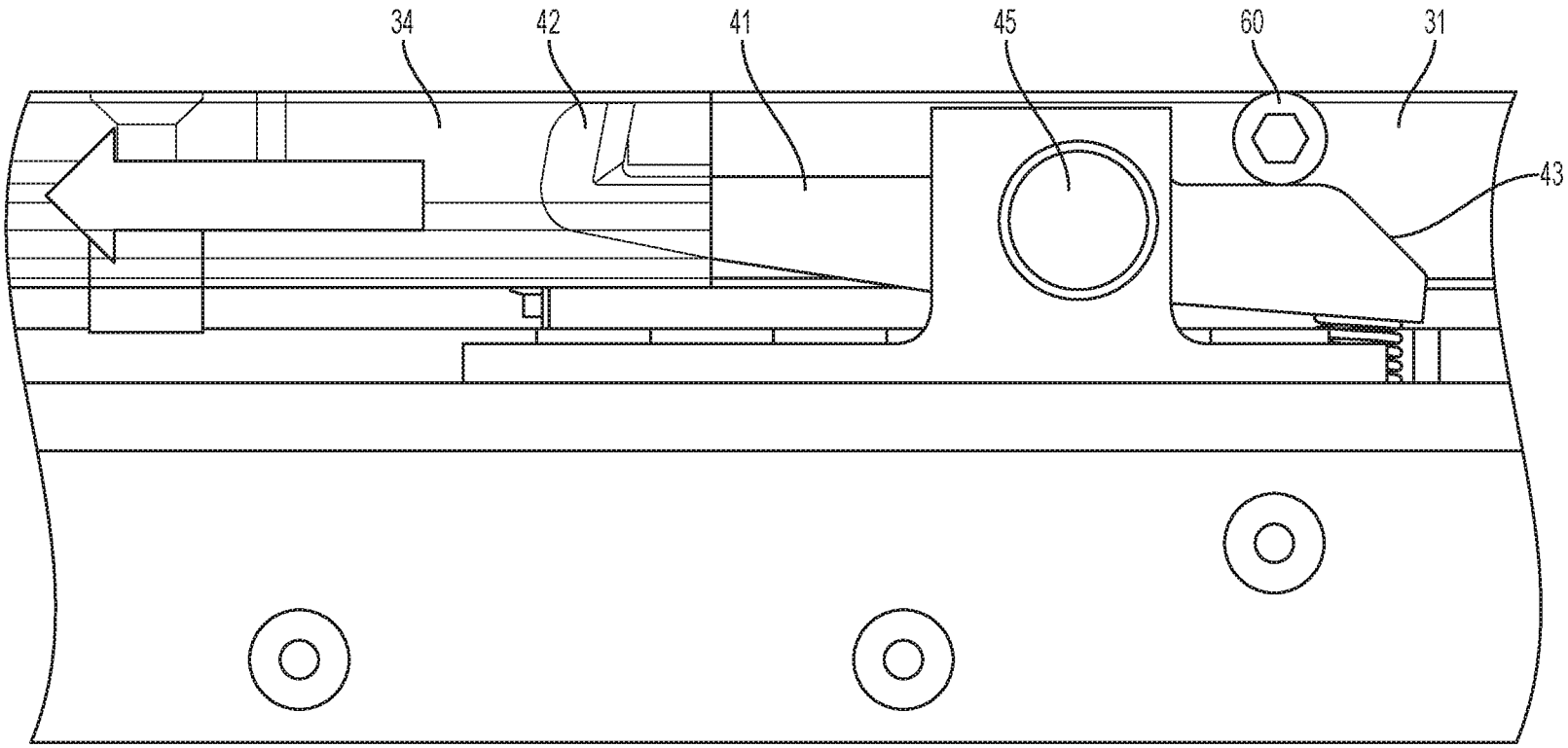
FIG. 10 is a top view of the portion of the retention mechanism of FIG. 5 when the door operator mechanism has experienced a mechanical failure.
Figure 11A:
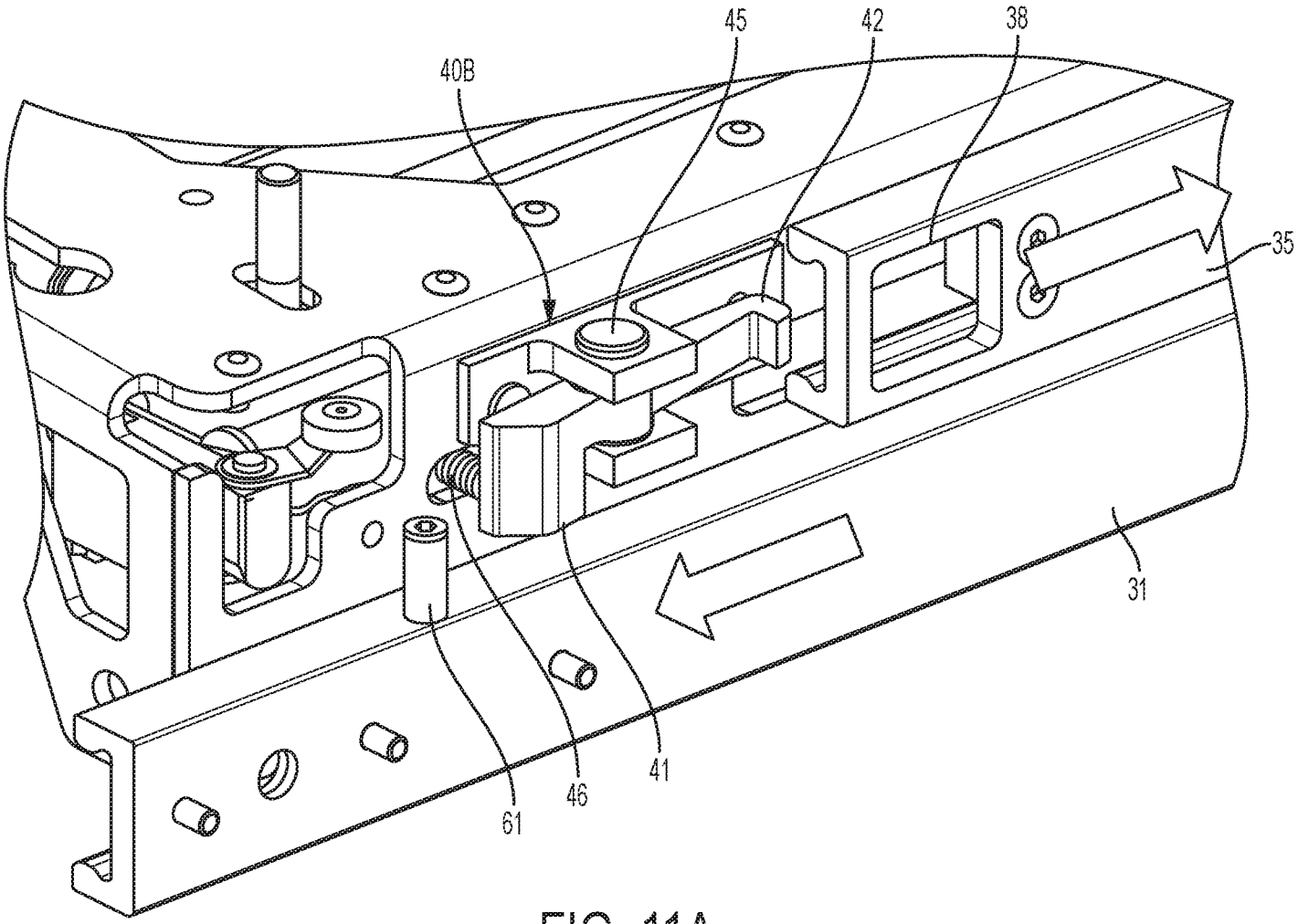
FIGS. 11A, 11B, and 11C are perspective views of a portion of the retention mechanism of FIG. 5 when the door is in an unlocked condition, when the door is in a closed and locked condition, and when the door operator mechanism has experienced a mechanical failure, respectively.
Figure 11B:
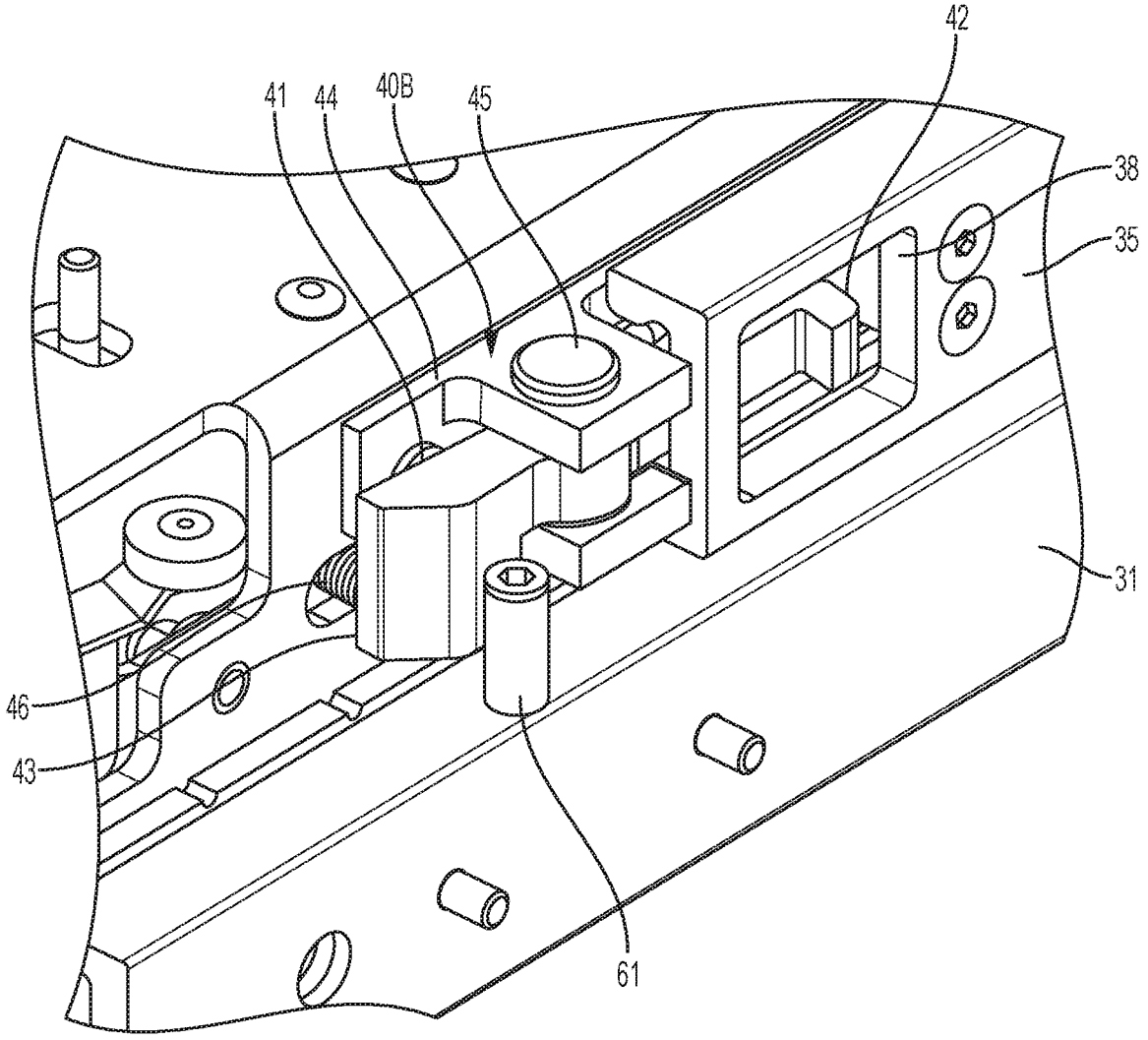
Figure 11C:
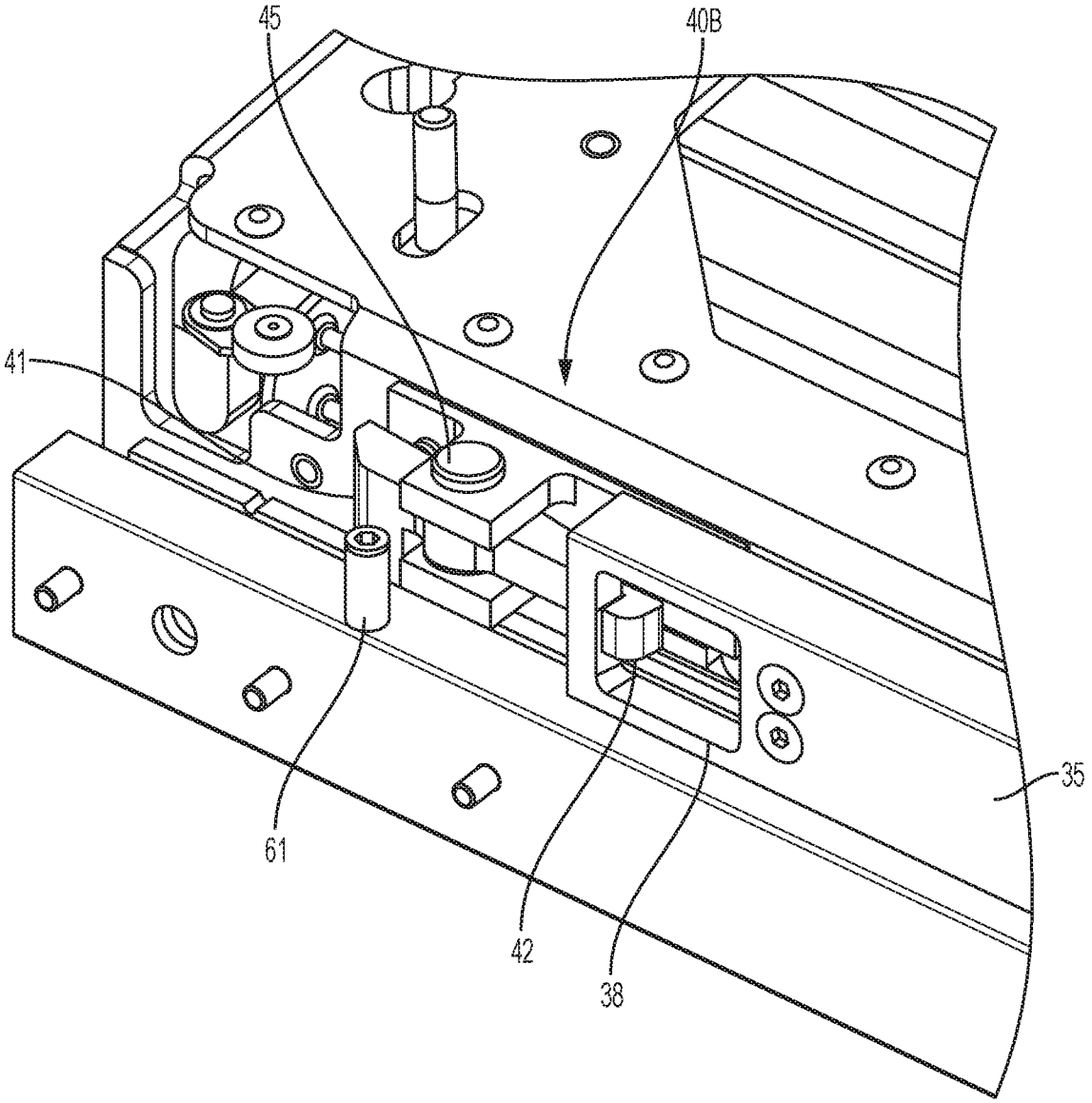

As shown in FIGS. 5-11C, the first track 31 includes an aperture or mortise 34 defined in the first track 31 adjacent to the first end 32. The second track 35 also includes an aperture or mortise 38 defined in the second track 35 adjacent to the first end 36. As shown in FIGS. 10 and 11C, each of the first track 31 and the second track 35 is engaged by the hook member 42 of the respective retention hook 41 at the respective aperture 34, 38 to maintain the track 31, 35 in the closed position.

With reference to FIGS. 5-11C, when there is no failure in the door operator system 22 and the bi-parting doors 12, 14 are closing, the first track 31 moves linearly toward the first retention assembly 40A. The second track 35 moves sympathetically in the opposite direction toward the second retention assembly 40B. As the doors 12, 14 move to the closed and locked position, the engagement members 60, 61 disposed on the second ends 37, 33 of the respective second track 35 and first track 31 come into engagement with the ramp surface 43 on the retention hook 41 of the respective first and second retention assembly 40A, 40B to cause the retention hook 41 to pivot on the pivot shaft 45 from the releasing position, shown in FIGS. 8A, 9B, and 11A, to the retaining position, shown in FIGS. 8B, 9A, 10, 11B, and 11C, which is the position of the retention hook 41 when the doors 12, 14 are in the closed and locked position. This movement is set to occur as the aperture/mortise 34 in the first track 31 is lined up with the hook member 42 of the retention hook 41. The aperture/mortise 34, 38 is wide enough so that there is actually no contact between the edges of the aperture/mortise 34, 38 and the hook member 42 during normal operation.

When the bi-parting doors 12, 14 are opening, the first and second tracks 31, 35 move linearly in opposite directions. This movement causes each of the first and second engagement members 60, 61 to move away from the retention hook 41 of the respective retention assembly 40A, 40B. This movement allows for the retention hook 41 to return to the releasing position through expansion of the spring 46. The engagement members 60, 61 are positioned on the respective tracks 35, 31 such that the engagement members 60, 61 disengage from the retention hooks 61 of the retention assemblies 40A, 40B before the hook members 42 come into engagement with the apertures/mortises 34, 38, thereby allowing free movement of the tracks 35, 31.

As shown in FIGS. 10 and 11C, when the door operator system 22 experiences a mechanical failure in association with one of the doors 12, 14, the door 12, 14 becomes limp and the limp door and its associated track 31, 35 are free to move in the opening direction. However, the other of the doors 12, 14 remains in the closed and locked position, which prevents movement of its associated track 31, 35. Accordingly, the retention hook 41 of the retention assembly 40A, 40B associated with the limp door 12, 14 remains in the retaining position, and the hook member 42 catches the edge of the aperture/mortise 34, 38 of the track 31, 35 associated with the limp door 12, 14, thereby preventing further movement of the track 31, 35 and retaining the limp door 12, 14 in the closed position.

According to another example of the present disclosure, the retention mechanism 30 may be provided in association with a single door 12. In this example, the retention mechanism includes a track 31 connected to the door 12 and movable with the door 12 between the open and closed positions. The track 31 includes a first end 32 and a second end 33. A retention assembly 40A is connected to the door operator frame 24 or to the transit vehicle 10 directly to retain the track 31 in the closed position. An engagement member 60, such as a striker pin, is movably connected to the transit vehicle 10 so as to be movable opposite to a movement of the track 31. For instance, the engagement member 60 may be operatively connected to the door operator system 22 for the single door 12 so as to be driven to move in an opposite direction to the movement of the door 12. The engagement member 60 engages the retention assembly 40A to cause the retention assembly 40A to retain the track 31 when the track 31 is in the closed position, as discussed above.

Further examples of the present disclosure will now be described in the following number clauses.

Clause 1: A retention mechanism (30) for a pair of bi-parting doors (12, 14) of a transit vehicle (10), the retention mechanism (30) comprising: a first track (31) configured to be connected to a first door (12) of the pair of bi-parting doors (12, 14), the first track (31) having a first end (32) and a second end (33), wherein the first track (31) is movable with the first door (12) between an open position and a closed position; a second track (35) configured to be connected to a second door (14) of the pair of bi-parting doors (12, 14), the second track (35) having a first end (36) and a second end (37), wherein the second track (35) is movable with the second door (14) between an open position and a closed position; a first retention assembly (40A) configured to be connected to the transit vehicle (10) and to retain the first track (31) in the closed position; a second retention assembly (40B) configured to be connected to the transit vehicle (10) to retain the second track (35) in the closed position; a first engagement member (60) connected to the second end (37) of the second track (35), the first engagement member (60) being configured to engage the first retention assembly (40A) to cause the first retention assembly (40A) to move to retain the first track (31) in the closed position when the second track (35) is in the closed position; and a second engagement member (61) connected to the second end (33) of the first track (31), the second engagement member (61) being configured to engage the second retention assembly (40B) to cause the second retention assembly (40B) to move to retain the second track (35) in the closed position when the first track (31) is in the closed position.

Clause 2: The retention mechanism (30) according to clause 1, further comprising: a first suspension member (50A) movably engaged by the first track (31), the first suspension member (50A) being configured to be fixedly connected to the transit vehicle (10); and a second suspension member (50B) movably engaged by the second track (35), the second suspension member (50B) being configured to be fixedly connected to the transit vehicle (10), wherein the first suspension member (50A) and the second suspension member (50B) are configured to vertically support the first track (31) and the second track (35), respectively, with respect to the transit vehicle (10).

Clause 3: The retention mechanism (30) according to clause 2, wherein each of the first suspension member (50A) and the second suspension member (50B) comprises at least one roller (51) configured to rollably engage the respective first track (31) and second track (35).

Clause 4: The retention mechanism (30) according to clause 2 or 3, wherein each of the first suspension member (50A) and the second suspension member (50B) comprises a set of rollers (51) configured to rollably engage the respective first track (31) and second track (35).

Clause 5: The retention mechanism according to any one of clauses 2-4, wherein each of the first suspension member (50A) and the second suspension member (50B) comprises at least one sliding member configured to slidably engage the respective first track (31) and second track (35).

Clause 6: The retention mechanism (30) according to any one of clauses 1-5, wherein each of the first retention assembly (40A) and the second retention assembly (40B) comprises a retention hook (41) configured to be pivotably connected to the transit vehicle (10), and wherein each retention hook (41) is pivotable between a retaining position in which the retention hook (41) can engage the first end (32, 36) of the respective first track (31) and second track (35) to retain the respective first track (31) and second track (35) in the closed position and a releasing position in which the retention hook (41) releases the respective first track (31) and second track (35) to move between the open and closed positions.

Clause 7: The retention mechanism (30) according to clause 6, wherein each retention hook (41) comprises a first end configured to engage the respective first track (31) and second track (35) and an opposing second end configured to be engaged by the respective first engagement member (60) and second engagement member (61) to cause the retention hook (41) to be moved to the retaining position.

Clause 8: The retention mechanism (30) according to clause 7, wherein the first end of each retention hook (41)

comprises a hook member (42) configured to engage the respective first track (31) and second track (35) and the second end of each retention hook (41) comprises a ramp surface (43) configured to be engaged by the respective first engagement member (60) and second engagement member (61).

Clause 9: The retention mechanism (30) according to any one of clauses 6-8, wherein each of the first retention assembly (40A) and the second retention assembly (40B) further comprises: a support plate (44) configured to mount the retention assembly (40A, 40B) on the transit vehicle (10); a pivot shaft (45) configured to pivotably support the retention hook (41) on the support plate (44); and a spring (46) configured to engage the retention hook (41) to bias the retention hook (41) to the releasing position.

Clause 10: The retention mechanism (30) according to any one of clauses 1-9, wherein each of the first engagement member (60) and the second engagement member (61) comprises a striker pin extending from the respective second track (35) and first track (31).

Clause 11: The retention mechanism (30) according to any one of clauses 1-11, wherein each of the first track (31) and the second track (35) comprises an aperture (34, 38) defined adjacent to the first end (32, 36) thereof and wherein each of the first track (31) and the second track (35) is configured to be engaged at the aperture (34, 38) by the respective first retention assembly (40A) and second retention assembly (40B).

Clause 12: A bi-parting door assembly for a transit vehicle (10) having a door opening (18) formed in a wall (20) of the transit vehicle (10), the door assembly comprising: a first door (12) and a second door (14) disposed adjacent to the wall (20); a door operator system (22) configured to move the first door (12) and the second door (14) in opposing directions along the door opening (18) between respective open and closed positions, the door operator system (22) comprising a door operator frame (24) configured to be mounted on the transit vehicle (10) above the door opening (18); and a retention mechanism (30) for the first door (12) and the second door (14), the retention mechanism (30) comprising: a first track (31) connected to the first door (12), the first track (31) having a first end (32) and a second end (33), wherein the first track (31) is movable with the first door (12) between the open position and the closed position; a second track (35) connected to the second door (14), the second track (35) having a first end (36) and a second end (37), wherein the second track (35) is movable with the second door (14) between the open position and the closed position; a first retention assembly (40A) connected to the door operator frame (24), the first retention assembly (40A) being configured to retain the first track (31) in the closed position; a second retention assembly (40B) connected to the door operator frame (24), the second retention assembly (40B) being configured to retain the second track (35) in the closed position; a first engagement member (60) connected to the second end (37) of the second track (35), the first engagement member (60) being configured to engage the first retention assembly (40A) to cause the first retention assembly (40A) to move to retain the first track (31) in the closed position when the second track (35) is in the closed position; and a second engagement member (61) connected to the second end (34) of the first track (31), the second engagement member (61) being configured to engage the second retention assembly (40B) to cause the second retention assembly (40B) to move to retain the second track (35) in the closed position when the first track (31) is in the closed position.

Clause 13: The bi-parting door assembly according to clause 12, wherein the retention mechanism (30) is configured to maintain at least one of the first door (12) and the second door (14) in the respective closed position in an event of a mechanical failure of the door operator system (22).

Clause 14: The bi-parting door assembly according to clause 12 or 13, wherein each of the first track (31) and the second track (35) have a width greater than a width of the respective first door (12) and second door (14) to allow for lateral motion of the respective first door (12) and second door (14) in a direction toward the respective open position up to a maximum distance equal to the width of the respective first door (12) and second door (14).

Clause 15: The bi-parting door assembly according to any one of clauses 12-14, wherein the retention mechanism (30) further comprises: a first suspension member (50A) movably engaged by the first track (31) and fixedly connected to the door operator frame (24); and a second suspension member (50B) movably engaged by the second track (35) and fixedly connected to the door operator frame (24), wherein the first suspension member (50A) and the second suspension member (50B) are configured to vertically support the first track (31) and the second track (35), respectively, with respect to the transit vehicle (10).

Clause 16: The bi-parting door assembly according to any one of clauses 12-15, wherein each of the first retention assembly (40A) and the second retention assembly (40B) comprises a retention hook (41) configured to be pivotably connected to the transit vehicle (10), and wherein each retention hook (41) is pivotable between a retaining position in which the retention hook (41) can engage the first end (32, 36) of the respective first track (31) and second track (35) to retain the respective first track (31) and second track (35) in the closed position and a releasing position in which the retention hook (41) releases the respective first track (31) and second track (35) to move between the open and closed positions.

Clause 17: The bi-parting door assembly according to clause 16, wherein each retention hook (41) comprises a first end configured to engage the respective first track (31) and second track (35) and an opposing second end configured to be engaged by the respective first engagement member (60) and second engagement member (61) to cause the retention hook (41) to be moved to the retaining position.

Clause 18: The bi-parting door assembly according to clause 17, wherein the first end of each retention hook (41) comprises a hook member (42) configured to engage the respective first track (31) and second track (35) and the second end of each retention hook comprises a ramp surface (43) configured to be engaged by the respective first engagement member (60) and second engagement member (61).

Clause 19: The bi-parting door assembly according to any one of clauses 16-18, wherein each of the first retention assembly (40A) and the second retention assembly (40B) further comprises: a support plate (44) connected to the door operator frame (24) and configured to mount the retention assembly (40A, 40B) on the door operator frame (24); a pivot shaft (45) configured to pivotably support the retention hook (41) on the support plate (44); and a spring (46) configured to engage the retention hook (41) to bias the retention hook (41) to the releasing position.

Clause 20: A retention mechanism (30) for a transit vehicle door (12), the retention mechanism (30) comprising: a track (31) configured to be connected to the door (12), the track (31) having a first end (32) and a second end (33), wherein the track (31) is movable with the door (12) between an open position and a closed position; a retention assembly (40A) configured to be connected to the transit vehicle (10) and to retain the track (31) in the closed position; and an engagement member (60) configured to be movably connected to the transit vehicle (10) so as to be movable opposite to a movement of the track (31), wherein the engagement member (60) is configured to engage the retention assembly (40A) to cause the retention assembly (40A) to retain the track (31) when the track (31) is in the closed position.

Clause 21: A bi-parting door assembly for a transit vehicle (10) having a door opening (18) formed in a wall (20) of the transit vehicle (10), the door assembly comprising: a first door (12) and a second door (14) disposed adjacent to the wall (20); a door operator system (22) configured to move the first door (12) and the second door (14) in opposing directions along the door opening (18) between respective open and closed positions, the door operator system (22) comprising a door operator frame (24) configured to be mounted on the transit vehicle (10) above the door opening (18); and a retention mechanism (30) according to any one of clauses 1-11.

It is to be understood that the invention may assume various alternative variations and step sequences, except where expressly specified to the contrary. It is also to be understood that the specific devices and processes illustrated in the attached drawings, and described in the specification, are simply exemplary embodiments or aspects of the invention. Although the invention has been described in detail for the purpose of illustration based on what is currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope thereof. For example, it is to be understood that the present invention contemplates that, to the extent possible, one or more features of any embodiment or aspect can be combined with one or more features of any other embodiment or aspect.

The invention claimed is:

1. A retention mechanism for a pair of bi-parting doors of a transit vehicle, the retention mechanism comprising:

a first track configured to be connected to a first door of the pair of bi-parting doors, the first track having a first end and a second end, wherein the first track is movable with the first door between an open position and a closed position;

a second track configured to be connected to a second door of the pair of bi-parting doors, the second track having a first end and a second end, wherein the second track is movable with the second door between an open position and a closed position;

a first retention assembly configured to be connected to the transit vehicle and to retain the first track in the closed position;

a second retention assembly configured to be connected to the transit vehicle to retain the second track in the closed position;

a first engagement member connected to the second end of the second track, the first engagement member being configured to engage the first retention assembly to cause the first retention assembly to move to retain the first track in the closed position when the second track is in the closed position; and a second engagement member connected to the second end of the first track, the second engagement member being configured to engage the second retention assembly to cause the second retention assembly to move to retain the second track in the closed position when the first track is in the closed position.

2. The retention mechanism according to claim 1, further comprising:

a first suspension member movably engaged by the first track, the first suspension member being configured to be fixedly connected to the transit vehicle; and a second suspension member movably engaged by the second track, the second suspension member being configured to be fixedly connected to the transit vehicle, wherein the first suspension member and the second suspension member are configured to vertically support the first track and the second track, respectively, with respect to the transit vehicle.

3. The retention mechanism according to claim 2, wherein each of the first suspension member and the second suspension member comprises at least one roller configured to rollably engage the respective first track and second track.

4. The retention mechanism according to claim 2, wherein each of the first suspension member and the second suspension member comprises a set of rollers configured to rollably engage the respective first track and second track.

5. The retention mechanism according to claim 2, wherein each of the first suspension member and the second suspension member comprises at least one sliding member configured to slidably engage the respective first track and second track.

6. The retention mechanism according to claim 1, wherein each of the first retention assembly and the second retention assembly comprises a retention hook configured to be pivotably connected to the transit vehicle, and wherein each retention hook is pivotable between a retaining position in which the retention hook can engage the first end of the respective first track and second track to retain the respective first track and second track in the closed position and a releasing position in which the retention hook releases the respective first track and second track to move between the open and closed positions.

7. The retention mechanism according to claim 6, wherein each retention hook comprises a first end configured to engage the respective first track and second track and an opposing second end configured to be engaged by the respective first engagement member and second engagement member to cause the retention hook to be moved to the retaining position.

8. The retention mechanism according to claim 7, wherein the first end of each retention hook comprises a hook member configured to engage the respective first track and second track and the second end of each retention hook comprises a ramp surface configured to be engaged by the respective first engagement member and second engagement member.

9. The retention mechanism according to claim 6, wherein each of the first retention assembly and the second retention assembly further comprises:

a support plate configured to mount the retention assembly on the transit vehicle;

a pivot shaft configured to pivotably support the retention hook on the support plate; and a spring configured to engage the retention hook to bias the retention hook to the releasing position.

10. The retention mechanism according to claim 1, wherein each of the first engagement member and the second engagement member comprises a striker pin extending from the respective second track and first track.

11. The retention mechanism according to claim 1, wherein each of the first track and the second track comprises an aperture defined adjacent to the first end thereof and wherein each of the first track and the second track is configured to be engaged at the aperture by the respective first retention assembly and second retention assembly.

12. A bi-parting door assembly for a transit vehicle having a door opening formed in a wall of the transit vehicle, the door assembly comprising:

a first door and a second door disposed adjacent to the wall;

a door operator system configured to move the first door and the second door in opposing directions along the door opening between respective open and closed positions, the door operator system comprising a door operator frame configured to be mounted on the transit vehicle above the door opening; and a retention mechanism for the first door and the second door, the retention mechanism comprising:

a first track connected to the first door, the first track having a first end and a second end, wherein the first track is movable with the first door between the open position and the closed position;

a second track connected to the second door, the second track having a first end and a second end, wherein the second track is movable with the second door between the open position and the closed position;

a first retention assembly connected to the door operator frame, the first retention assembly being configured to retain the first track in the closed position;

a second retention assembly connected to the door operator frame, the second retention assembly being configured to retain the second track in the closed position;

a first engagement member connected to the second end of the second track, the first engagement member being configured to engage the first retention assembly to cause the first retention assembly to move to retain the first track in the closed position when the second track is in the closed position; and a second engagement member connected to the second end of the first track, the second engagement member being configured to engage the second retention assembly to cause the second retention assembly to move to retain the second track in the closed position when the first track is in the closed position.

13. The bi-parting door assembly according to claim 12, wherein the retention mechanism is configured to maintain at least one of the first door and the second door in the respective closed position in an event of a mechanical failure of the door operator system.

14. The bi-parting door assembly according to claim 12, wherein each of the first track and the second track have a width greater than a width of the respective first door and second door to allow for lateral motion of the respective first door and second door in a direction toward the respective open position up to a maximum distance equal to the width of the respective first door and second door.

15. The bi-parting door assembly according to claim 12, wherein the retention mechanism further comprises:

a first suspension member movably engaged by the first track and fixedly connected to the door operator frame; and a second suspension member movably engaged by the second track and fixedly connected to the door operator frame, wherein the first suspension member and the second suspension member are configured to vertically support the first track and the second track, respectively, with respect to the transit vehicle.

16. The bi-parting door assembly according to claim 12, wherein each of the first retention assembly and the second retention assembly comprises a retention hook configured to be pivotably connected to the transit vehicle, and wherein each retention hook is pivotable between a retaining position in which the retention hook can engage the first end of the respective first track and second track to retain the respective first track and second track in the closed position and a releasing position in which the retention hook releases the respective first track and second track to move between the open and closed positions.

17. The bi-parting door assembly according to claim 16, wherein each retention hook comprises a first end configured to engage the respective first track and second track and an opposing second end configured to be engaged by the respective first engagement member and second engagement member to cause the retention hook to be moved to the retaining position.

18. The bi-parting door assembly according to claim 17, wherein the first end of each retention hook comprises a hook member configured to engage the respective first track and second track and the second end of each retention hook comprises a ramp surface configured to be engaged by the respective first engagement member and second engagement member.

19. The bi-parting door assembly according to claim 16, wherein each of the first retention assembly and the second retention assembly further comprises:

a support plate connected to the door operator frame and configured to mount the retention assembly on the door operator frame;

a pivot shaft configured to pivotably support the retention hook on the support plate; and a spring configured to engage the retention hook to bias the retention hook to the releasing position.

* * * * *